US007733024B2

(12) United States Patent
Woo et al.

(10) Patent No.: US 7,733,024 B2
(45) Date of Patent: Jun. 8, 2010

(54) FLEXIBLE PLASMA DISPLAY PANEL AND SEALING THEREOF

(75) Inventors: Seok-Gyun Woo, Suwon-si (KR); Jae-Ik Kwon, Suwon-si (KR); Won-Ju Yi, Suwon-si (KR); Kyoung-Doo Kang, Suwon-si (KR); Ho-Young Ahn, Suwon-si (KR); Soo-Ho Park, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 433 days.

(21) Appl. No.: 11/746,208

(22) Filed: May 9, 2007

(65) Prior Publication Data

US 2008/0106196 A1 May 8, 2008

(30) Foreign Application Priority Data

Nov. 7, 2006 (KR) ..... 10-2006-0109520

(51) Int. Cl.
*H01J 17/49* (2006.01)

(52) U.S. Cl. ..... 313/582

(58) Field of Classification Search ..... 313/582
See application file for complete search history.

(56) References Cited

U.S. PATENT DOCUMENTS

| | | | | |
|---|---|---|---|---|
| 4,001,635 | A * | 1/1977 | D'Auria et al. | 347/233 |
| 4,035,690 | A * | 7/1977 | Roeber | 313/586 |
| 5,654,727 | A * | 8/1997 | Lepselter | 313/491 |
| 5,831,374 | A * | 11/1998 | Morita et al. | 313/46 |
| 6,086,441 | A * | 7/2000 | Akiguchi et al. | 445/24 |
| 2004/0166762 | A1 * | 8/2004 | Green et al. | 445/24 |
| 2007/0228952 | A1 * | 10/2007 | Kwon et al. | 313/580 |
| 2007/0228962 | A1 * | 10/2007 | Woo et al. | 313/582 |
| 2008/0122358 | A1 * | 5/2008 | Kwon et al. | 313/583 |
| 2009/0072702 | A1 * | 3/2009 | Kwon et al. | 313/485 |

FOREIGN PATENT DOCUMENTS

KR 2001-68831 7/2001

* cited by examiner

*Primary Examiner*—Peter Macchiarolo
(74) *Attorney, Agent, or Firm*—Stein McEwen, LLP

(57) ABSTRACT

A flexible plasma display panel including a display area defined by a first substrate and a second substrate, which are disposed to face each other to form discharge spaces therebetween, wherein the first substrate and the second substrate are flexible and include a plurality of electrodes; and a sealing area for sealing the first substrate and the second substrate by compressing the first and second substrates on edges of the display area.

9 Claims, 5 Drawing Sheets

FLEXIBLE PLASMA DISPLAY PANEL AND SEALING THEREOF

CROSS-REFERENCE TO RELATED APPLICATIONS

This application claims the benefit of Korean Patent Application No. 2006-109520, filed on Nov. 7, 2006, in the Korean Intellectual Property Office, the disclosure of which is incorporated herein in its entirety by reference.

BACKGROUND OF THE INVENTION

1. Field of the Invention

Aspects of the present invention relate to a plasma display panel including flexible substrates, and more particularly, to a plasma display panel having flexible substrates that can be sealed easily and stably as the flexible substrates are compression-coupled in a sealing area about a display area.

2. Description of the Related Art

Recently, as transmission of information has greatly increased due to the development of communication technologies and wide distribution of the Internet, ubiquitous display devices for use in public and private places have been introduced. In order to realize such display environments, display devices must be freely installed in various spaces.

Conventional plasma display panels including substrates formed of a non-flexible material, such as a rigid glass, are thick, heavy, and inflexible. Areas in which rigid plasma display panels can be used are limited, and thus, ongoing research is dedicated to plasma display panels using substrates formed of flexible materials so as to provide flexible plasma display panels for use in non-traditional locations.

Plasma display panels are flat panel display devices displaying images using a gas discharge phenomenon, and have superior characteristics, such as high image quality, ultra-thin thickness, light weight, and wide viewing angle all in a large screen. In addition, plasma display panels can be easily fabricated and can have large sizes. Therefore, the plasma display panels are considered to be the next generation of large panel displays.

In general, a plasma display panel includes a discharge gas injected into a plurality of discharge spaces formed between a pair of substrates. The discharge gas generates ultraviolet rays when electrons of the discharge gas are excited by a voltage potential. The ultraviolet rays then excite electrons in phosphor materials disposed in the discharge spaces, which then emit visible rays. The discharge spaces are arranged and driven so as to display still or moving images.

A process of fabricating the conventional plasma display panel having the rigid glass substrate includes sealing the pair of substrates using a sealing material, such as a frit glass. To seal the pair of substrates together, frit in a melted or a paste state is applied along edges of the substrates using a printing method or a dispensing method, and then, dried and baked. When the sealing of substrates is completed, an impurity gas in the plasma display panel is released and purged, and a discharge gas is filled in the panel.

As described above, the sealing member must stably couple the substrates and maintain an airtight seal of the panel so that the discharge gas can be filled and maintained in the plasma display panel.

The conventional sealing method using frit can stably couple the conventional rigid glass substrates; however, such frit is not suitable for the plasma display panel having flexible substrates.

As the frit is a glass material, it becomes rigid after drying and baking are effected on the substrates.

If the frit glass is applied on the flexible substrates, the flexibility of the substrates may be degraded. In addition, when the frit is baked after it is applied on the substrates, the frit can shrink. Thus, the frit or the substrate may break and the substrates are not firmly sealed, resulting in degraded sealing of the substrates and increased complexity of the sealing of the substrates.

SUMMARY OF THE INVENTION

Aspects of the present invention provide a plasma display panel including flexible substrates that can be easily and stably sealed.

Aspects of the present invention also provide a plasma display panel, in which flexible substrates are coupled to each other stably and a sealing status of the panel can be maintained stably.

According to an aspect of the present invention, there is provided a plasma display panel including: a first substrate and a second substrate which are disposed to face each other to form discharge spaces; and a sealing area at a periphery of the first substrate and the second substrate for sealing the first substrate and the second substrate and the first and second substrates include a plurality of electrodes on surfaces, and are flexible and sealed at the sealing area.

The first substrate and the second substrate may be sealed using a thermal compression method to compress the first and second substrates at the sealing area.

The sealing area may include an adhesive sheet disposed between the first substrate and the second substrate, and the first substrate and the second substrate may be coupled to each other when the adhesive sheet is compressed with heat between the first substrate and the second substrate.

The first substrate and the second substrate may be compressed using ultrasonic waves at the sealing area.

According to another aspect of the present invention, there is provided a plasma display panel including: a electrode sheet having a plurality of electrodes and a plurality of discharge spaces; and a first substrate and a second substrate facing each other, and the electrode sheet is disposed between the first substrate and the second substrate, and the first substrate, the second substrate, and the electrode sheet are flexible and flexibly sealed.

The plasma display panel may define a display area to display images using a gas discharge, where the discharge spaces and the electrodes are disposed in the display area, and a non-display area surrounding the display area, and the non-display area may include a sealing area, in which the first substrate, the second substrate, and the electrode sheet may be compressed and coupled to each other.

The first substrate, the second substrate, and the electrode sheet may be sealed by a thermal compression at the sealing area.

The sealing area may include adhesive sheets disposed between the first substrate and the electrode sheet and between the electrode sheet and the second substrate, and the first substrate, the second substrate, and the electrode sheet may be coupled when the adhesive sheet is compressed between the first substrate and the second substrate and heated.

The first substrate, the second substrate, and the electrode sheet may be sealed using ultrasonic waves at the sealing area.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
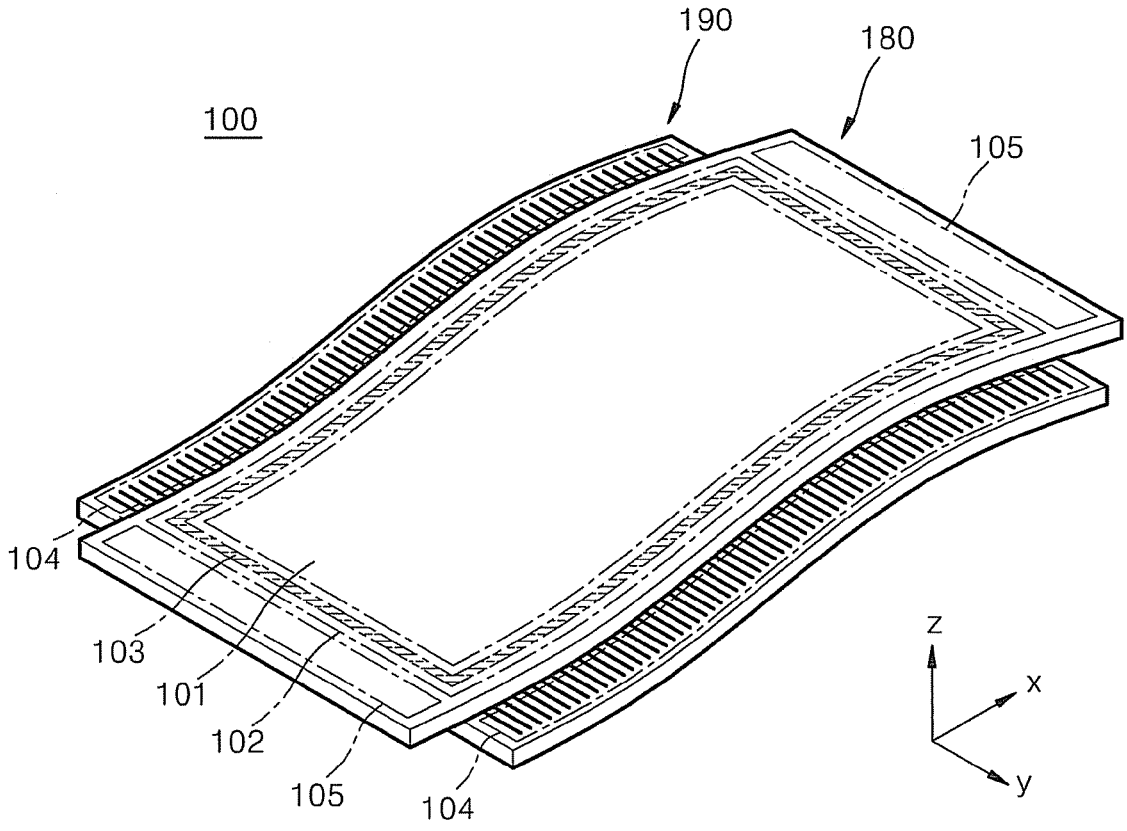
FIG. 1 is a perspective view of a plasma display panel according to aspects of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a perspective view of a plasma display panel 100 according to aspects of the present invention. Referring to FIG. 1, the plasma display panel 100 includes a first substrate 180 and a second substrate 190, which face each other so as to form discharge spaces between them. The first and second substrates 180 and 190 are flexible and include a plurality of electrodes on surfaces thereof. The electrodes (shown in FIG. 2) are disposed on the surfaces of the first substrate 180 and the second substrate 190 that face each other, or the electrodes are disposed on the surfaces of the first substrate 180 and the second substrate 190 that are disposed between the first substrate 180 and the second substrate 190.

The plasma display panel 100 is formed by coupling the first and second substrates 180 and 190 to each other, and includes a display area 101, a non-display area 102, and a sealing area 103. The display area 101 displays images using discharge spaces in which a gas discharge occurs. The discharge spaces are disposed between the first and second substrates 180 and 190. The non-display area 102 does not display images.

The sealing area 103 is formed in the non-display area 102 that is formed outside or about the periphery of the display area 101. The sealing area 103 is an area in which the first and second substrates 180 and 190 are coupled. The first and second substrates 180 and 190 are coupled to each other by thermal compression at the sealing area 103.

Terminal portions 104 and 105 are portions of the first and second substrates 180 and 190 that do not overlap with each other. The terminal portions 104 and 105 serve as terminals for connecting electrodes formed on the first and second substrates 180 and 190 to external connectors (not shown).

Figure 2:
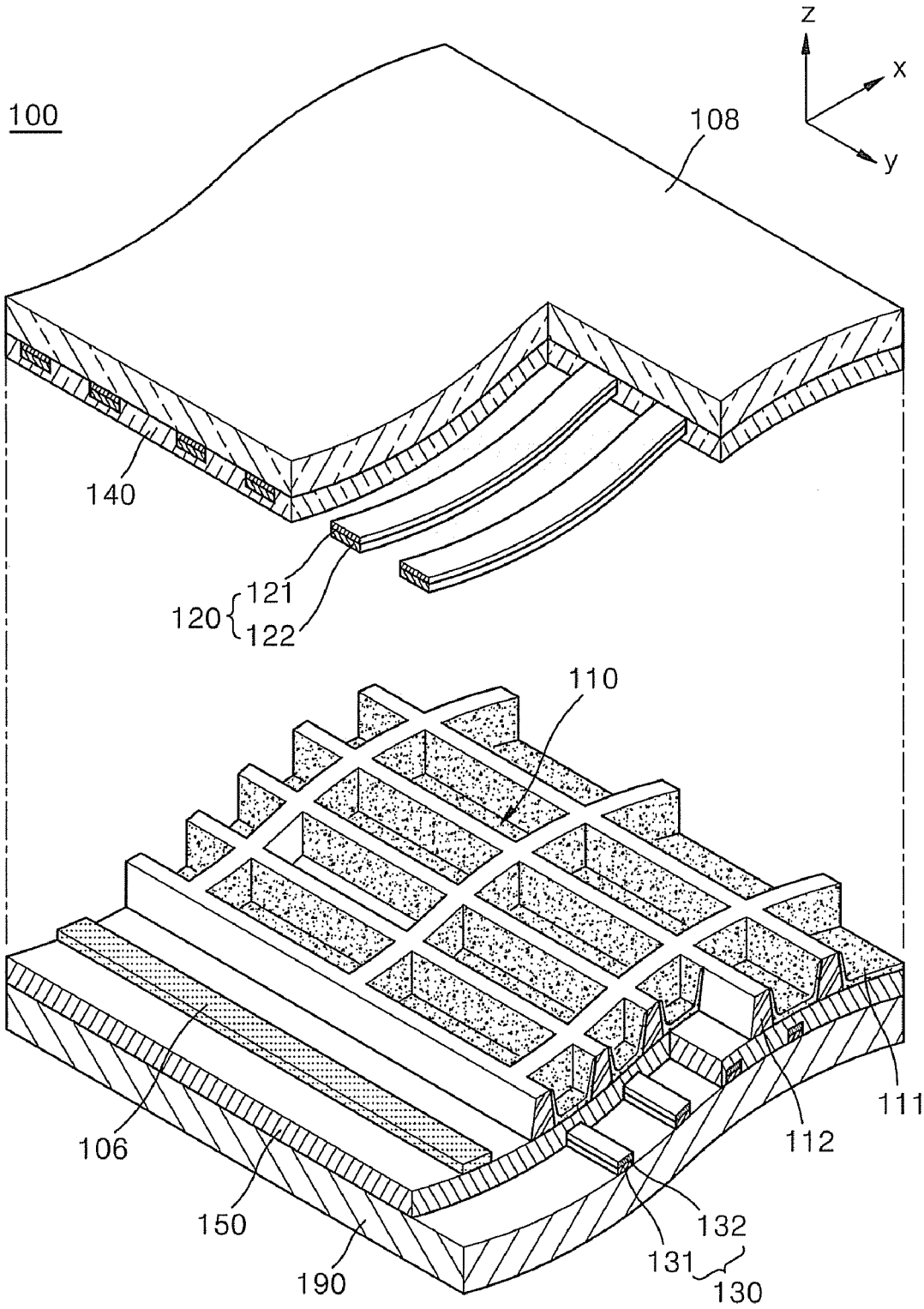
FIG. 2 is a perspective view of an inner structure in the plasma display panel of FIG. 1.
Figure 3:
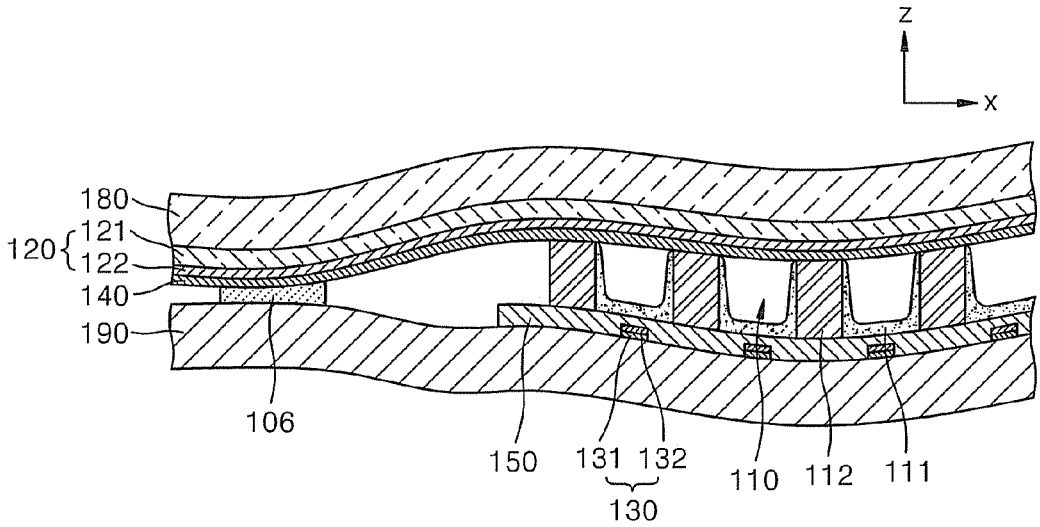
FIG. 3 is a cross-sectional view showing a side portion of the plasma display panel of FIG. 1.

FIG. 2 is a perspective view showing an inner structure of the plasma display panel of FIG. 1, and FIG. 3 is a cross-sectional view showing a side portion of the plasma display panel of FIG. 1. As shown in FIG. 2, the first and second substrates 180 and 190 are flexible flat plates. The first and second substrates 180 and 190 can be formed of a material including at least one of a polyethersulfone resin, a polyimide, and a material including an organic material. The first and second substrates 180 and 190 are arranged at a predetermined distance so as to form a plurality of discharge spaces 110, in which a discharge gas is filled. Since the plasma display panel 100 includes the flexible substrates 180 and 190, the plasma display panel 100 can be used in more areas than the conventional plasma display panel having non-flexible substrates.

A plurality of display electrodes 120 are formed on the surface of the first substrate 180. The display electrodes 120 extend on the surface of the first substrate 180 to receive electric signals from the external connector (not shown) and to generate a discharge. The display electrodes 120 can be formed to include a single layer of a conductive material or to include multiple layers as described in connection with the aspects of the invention illustrated in FIG. 2. The display electrode 120 includes a plating seed layer 121 formed on the first substrate 180, and a plating layer 122 plated on the plating seed layer 121. An insulating layer 140 can be formed on surfaces of the display electrodes 120 and the first substrate 180, or the insulating layer 140 can be formed on the surface of the first substrate 180 to cover the display electrodes 120. Further, the insulating layer 140 may be formed of a dielectric material.

The plating seed layer 121 is a base layer on the first substrate 180 to provide an area on the first substrate 180 in which to form the plating layer 122. The plating seed layer 121 can be formed of a flexible material that can be easily deposited on the first substrate 180, such as polyethersulfone resin or polyimide.

A plurality of address electrodes 130 are formed on the surface of the second substrate 190. The address electrodes 130 are elongated so as to intersect with the display electrodes 120. Similar to the display electrodes 120, each address electrode 130 includes a plating seed layer 131 and a plating layer 132. In addition, an insulating layer 150 can be formed on the address electrodes 130 and on the surface of the second substrate 190, or the insulating layer can be formed on the surface of the second substrate 190 to cover the address electrodes 130.

The plating layers 122 and 132 are conductive and operate as electrodes that transmit the electric signals from signal supply units (not shown) to the discharge spaces 110. The plating layers 122 and 132 can be formed of a material that can be easily plated on the plating seed layers 121 and 131.

Through the structures of the electrodes 120 and 130, including the plating seed layers 121 and 131 and the plating layers 122 and 132 plated on the plating seed layers 121 and 131, the plurality of electrodes 120 and 130 can be easily formed on the surfaces of the flexible substrates 180 and 190.

The plating seed layers 121 and 131 and the plating layers 122 and 132 can be electroless seed layers and electroless plating layers, respectively. When the electroless seed layers and the electroless plating layers are used, the electrodes can be formed on the surfaces of the substrates 180 and 190 more easily than when electro-seed layers and electro-plating layers are used. The electrodes 120 and 130 may be formed on the surface of the first and second substrates 180 and 190 by chemical deposition or any other method.

The insulating layers 140 and 150 are formed on the plurality of electrodes 120 and 130. The insulating layers 140 and 150 can be formed of various materials, for example, the same flexible material as that of the substrates 180 and 190. The insulating layers 140 and 150 can include the polyethersulfone resin and/or the polyimide. When the insulating layers 140 and 150 are formed of the flexible material, the substrates 180 and 190 and the insulating layers 140 and 150 are all flexible. As a result, the flexibility of the substrates 180 and 190 can be improved.

If the insulating layers 140 and 150 are formed of the same material as that of the substrates 180 and 190, the degrees of the flexibilities of the insulating layers 140 and 150 and the substrates 180 and 190 can coincide with each other such that the insulating layers 140 and 150 have a same flexible characteristic. Therefore, cracks that may be formed in contacting portions between the insulating layers 140 and 150 and the substrates 180 and 190 can be prevented.

A plurality of barrier ribs 112 are formed between the first substrate 180 and the second substrate 190 to form the plurality of discharge spaces 110. A phosphor layer 111 is formed on surfaces of the discharge spaces 110, and the discharge gas is filled in the discharge spaces 110. The barrier ribs 112 can be formed as stripes or elongated, raised strips extending in one direction or as a matrix as shown according to aspects of the invention illustrated in FIG. 2.

In order to fill the discharge gas in the discharge spaces 110, the first substrate 180 and the second substrate 190 are first sealed to each other. To seal the first and second substrates 180 and 190, the first and second substrates 180 and 190 can be compressed to seal with each other by a thermal compression method in the sealing area (103 in FIG. 1).

The first and second substrates 180 and 190 are compressed to couple with each other at the sealing area 103 formed on the non-display area 102. The sealing area 103 can include an adhesive sheet 106 disposed between the first and second substrates 180 and 190 outside of the display area 101.

The adhesive sheet 106 can include a material such as a thermosetting epoxy resin. Therefore, the compressing of the first and second substrates 180 and 190 includes processes of attaching the adhesive sheet 106 on the second substrate 190 at the sealing area 103 and applying a predetermined heat and a predetermined pressure to the first and second substrates 180 and 190. When the adhesive sheet 106 is disposed between the first and second substrates 180 and 190, the application of the predetermined heat and the predetermined pressure causes the first and second substrates 180 and 190 to compress the adhesive sheet 106, thereby forming a seal. When the adhesive sheet 106 is not disposed between the first and second substrates 180 and 190, the application of the predetermined heat and the predetermined pressure cause the first and second substrates 180 and 190 to directly contact and seal.

When the adhesive sheet 106 is located at the sealing area 103 and the first and second substrates 180 and 190 are pressed while heating the substrates 180 and 190, the pressure and the heat are transferred to the adhesive sheet 106, and the first and second substrates 180 and 190 are coupled to each other at the sealing area 103. On the display area 101 where the first and second substrates 180 and 190 face each other with the barrier ribs 112 disposed therebetween, a predetermined distance is maintained between the first substrate 180 and the second substrate 190. However, at the sealing area 103, the flexible first and second substrates 180 and 190 can contact each other.

Instead of using the adhesive sheet 106, the first and second substrates 180 and 190 can be contacted to each other at the sealing area 103. The heat and pressure can be applied to the substrates 180 and 190, and thus, the first and second substrates 180 and 190 are directly coupled to each other. The first and second substrates 180 and 190 may exhibit a same flexible characteristic; and, the heat and pressure applied to the first and second substrates 180 and 190 allow for a flexible seal in the sealing area 103 so that the first and second substrates 180 and 190 are flexible and flexibly sealed. Further, the seal in the sealing area 103 can have the same flexible characteristics as the first and second substrates 180 and 190.

In addition, the first substrate 180 and the second substrate 190 can be coupled to each other using an ultrasonic wave fusing method in which ultrasonic waves are applied to the first and second substrates 180 and 190 at the sealing area 103 where the first and second substrate 180 and 190 are in contact. Further, the seal in the sealing area 103 can have the same flexible characteristics as the first and second substrates 180 and 190.

As described above, when methods using characteristics of the flexible substrates 180 and 190, such as the thermal compression or the ultrasonic wave fusing methods, the first and second substrates 180 and 190 can be stably coupled at the sealing area 103. In addition, since the first and second substrates 180 and 190 can be coupled to each other using the above simple compression method, the sealing process of the first and second substrates 180 and 190 can be easily effected.

According to the conventional sealing process using the sealing member such as a frit, the frit disposed between the first and second substrates and the substrates may break during the baking process. However, there is little or no possibility of breaking of the seal in the thermal compression or the ultrasonic wave fusing methods, and the sealing state between the first and second substrates 180 and 190 can be stably maintained.

FIG. 3 is a cross-sectional view showing a side portion of the plasma display panel of FIG. 1. The flexibility of the first and second substrates 180 and 190 is illustrated in FIG. 3 as the first and second substrates 180 and 190 allow for both an area in which barrier ribs 112 and discharge spaces 110 are formed and an area in which the first and second substrates 180 and 190 are sealed. Insulating layers 140 and 150 are disposed respectively on surfaces facing each other of the first and second substrates 180 and 190. Insulating layer 150 is disposed on the surface of the second substrate 190 to cover and protect the address electrodes 130. The insulating layer 150 does not extend into the sealing area 103 of FIG. 1. The insulating layer 150, however, is not limited thereto. The address electrodes 130 are formed of the seed plating layers 131 and the plating layers 132, as described above. The address electrodes 130 correspond and supply address signals to the discharge spaces 110.

The discharge spaces 110 are defined by the barrier ribs 112. The discharge spaces 110 are each coated with phosphor layers 111. The phosphor layers 111 are deposited on the sides of the barrier ribs 112 and a surface of insulating layer 150 on which the barrier ribs 112 are formed. The discharge spaces 110 are formed between the first and second substrates 180 and 190; and more particularly, the discharge spaces 110 are formed between the insulating layers 140 and 150. The discharge spaces 110 hold discharge gas that is excited by a voltage potential applied thereto via the address electrodes 130 and the display electrodes 120. The display electrodes 120 are also disposed to correspond to the discharge spaces 110. The address electrodes 130 and the display electrodes 120 are disposed to cross and identify a particular discharge space 110. The display electrodes 120 are formed of plating seed layers 121 and plating layers 122, as described above. The plating seed layers 121 are disposed on the surface of the first substrate 180 facing the second substrate 190. The plating layers 122 are disposed on the surface of the plating seed layers 121. And, the insulating layer 140 is disposed on the surface of the first substrate 180 facing the second substrate 190 and is formed to cover and protect the display electrodes 120.

As illustrated in FIG. 3, the adhesive sheet 106 is disposed between the first substrate 180 and the second substrate 190; and more particularly, the adhesive sheet 106 is disposed between the second substrate 190 and the insulating layer 140 disposed on the surface of the first substrate 180. However, the insulating layer 140 need not be formed to extend into the sealing area 103. Also, the adhesive sheet 106 need not be formed between the first and the second substrate 180 and 190 as the first and the second substrates 180 and 190 may be directly coupled, as described above.

Figure 4:
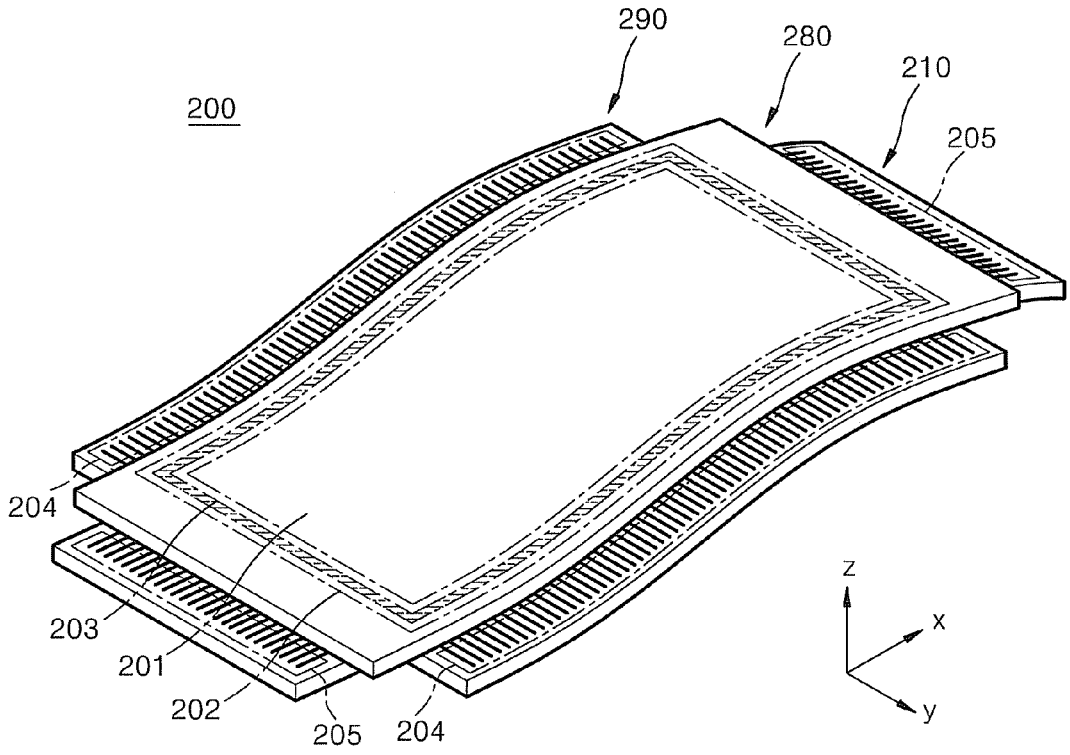
FIG. 4 is a perspective view of a plasma display panel according to another aspect of the present invention.

FIG. 4 is a perspective view of a plasma display panel 200 according to another aspect of the present invention. As shown in FIG. 4, the plasma display panel 200 includes an electrode sheet 210, and a first substrate 280 and a second substrate 290 disposed to face each other. The electrode sheet 210 is disposed between the first substrate 280 and the second substrate 290.

The plasma display panel 200 can be divided into a display area 201 and a non-display area 202. The display area 201 displays images using a discharge space in which a gas discharge occurs between the first and second substrates 280 and 290. The portion of the plasma display panel 200, except for the display area 201 corresponds to the non-display area 202, which does not display images.

A sealing area 203 is formed in the non-display area 202 located outside of the display area 201. The first and second substrates 280 and 290 are coupled to each other at the sealing area 203. The first and second substrates 280 and 290 are compressed about the electrode sheet 210 and coupled by thermal compression at the sealing area 203. The first and second substrates 280 and 290 may exhibit a same flexible characteristic; and, the heat and pressure applied to the first and second substrates 280 and 290 allow for a flexible seal in the sealing area 203 so that the first and second substrates 280 and 290 are flexible and flexibly sealed. Further, the seal in the sealing area 203 can have the same flexible characteristics as the first and second substrates 280 and 290.

The electrode sheet 210 includes terminal portions 205 that extend beyond the edges of the first and second substrates 280 and 290 in an X direction. In addition, the second substrate 290 also includes terminal portions 204 that extend beyond the edges of the first substrate 280 and the electrode sheet 210 in a Y direction. The terminal portions 204 and 205 serve as terminals for connecting the electrodes on the electrode sheet 210 and the address electrodes 260 on the second substrate 290 to external connectors (not shown).

Figure 5:
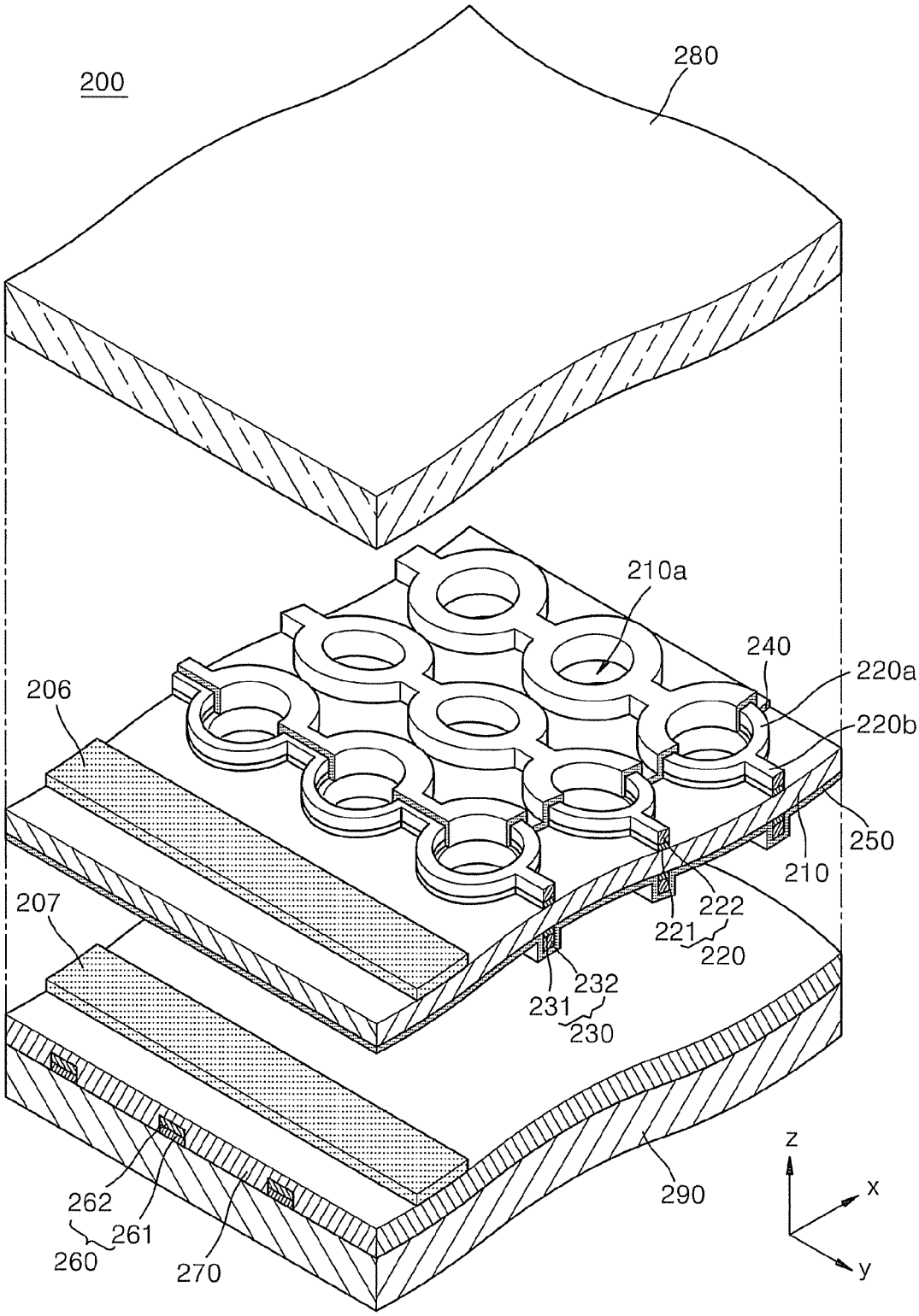
FIG. 5 is a perspective view of an inner structure in the plasma display panel of FIG. 4.
Figure 6:
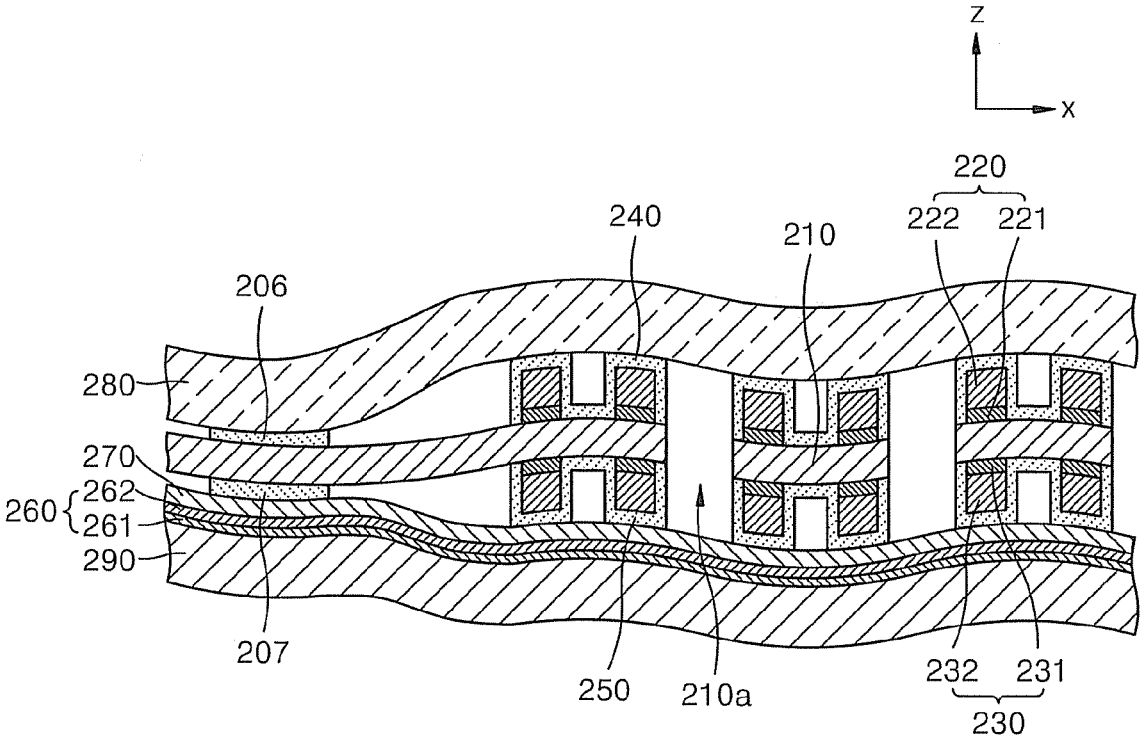
FIG. 6 is a cross-sectional view showing a side portion of the plasma display panel of FIG. 4.

FIG. 5 is a perspective view of an inner structure of the plasma display panel of FIG. 4, and FIG. 6 is a cross-sectional view showing a side portion of the plasma display panel of FIG. 4. As shown in FIG. 5, the first and second substrates 280 and 290 are flexible flat plates. The first and second substrates 280 and 290 can be formed of a material including at least one of polyethersulfone resin, polyimide, and an organic material. The first and second substrates 280 and 290 are disposed to face each other having a predetermined distance therebetween.

The electrode sheet is disposed between the first and second substrates 280 and 290 to form a plurality of discharge spaces 210*a*. Since the electrode sheet 210 is also formed of the material including one of polyethersulfone resin, polyimide, and the organic material, the electrode sheet 210 is flexible.

The plasma display panel 200 includes the flexible first and second substrates 280 and 290 and the flexible electrode sheet 210, and thus, can be used in more areas than the conventional plasma display panel including a non-flexible substrate, such as the rigid glass substrate.

The electrode sheet 210 includes a plurality of electrodes 220 and 230. The plurality of electrodes 220 and 230 are formed on a surface of the electrode sheet 210. However, the plurality of electrodes 220 and 230 can be embedded in the electrode sheet 210. The electrodes 220 and 230 are elongated on the surface of the electrode sheet 210, and receive electric signals from the external connector (not shown) to generate discharge.

The plurality of discharge spaces 210*a* are formed in the electrode sheet 210. The discharge spaces 210*a* penetrate through the electrode sheet 210 and extend from the surface of the electrode sheet 210 facing the first substrate 280 to the surface facing the second substrate 290. When the first and second substrates 280 and 290 are coupled to each other with the electrode sheet 210 disposed therebetween, a gas is filled in the discharge spaces 210*a*. The discharge spaces 210*a* can be formed in various shapes, such as a polygonal shape or an oval shape. Although it is not shown in the drawings, a phosphor layer can be formed on the surfaces the discharge spaces 210*a*.

The plurality of electrodes 220 and 230 are elongated electrodes and disposed on the surfaces of the electrode sheet 210. The plurality of electrodes 220 and 230 extend across the surfaces of the electrode sheet 210 to surround the discharge spaces 210*a* formed in the electrode sheet 210. However, the plurality of electrodes 220 and 230 are not limited thereto and may only surround a portion of the discharge spaces 210*a* formed in the electrode sheet 210. The plurality of electrodes 220 and 230 include first electrodes 220 formed on one surface of the electrode sheet 210 and second electrodes 230 formed on the other surface of the electrode sheet 210. The first electrodes 220 extend across the electrode sheet 210 in the Y direction and are disposed parallel to each other in the Y direction.

The second electrodes 230 extend in parallel to the first electrodes 220 in the Y direction but are disposed on the other side of the electrode sheet 210 in a Z direction. Therefore, the first and second electrodes 220 and 230 are separated from each other with the discharge spaces 210*a* disposed between them, in which the gas is filled, and thus, when an electric current is supplied to the first and second electrodes 220 and 230, the discharge occurs in the discharge spaces 210*a*.

The first electrodes 220 include discharge portions 220*a* contributing to the discharge and connecting portions 220*b* connecting the discharge portions 220*a*. The discharge portions 220*a* can be formed to completely surround the discharge spaces 210*a*. The discharge portions 220*a* are formed as circular loops to completely surround the discharge spaces 210*a*. However, the discharge portions 220*a* can surround some parts of the discharge spaces 210*a* or can be shaped differently from the circular shape. For example, the discharge portions 220*a* can be semi-circular shaped to surround some parts of the discharge spaces 210*a* or can be formed in various shapes such as a polygonal shape or an oval shape.

The first electrodes 220 can be formed as a single layer of a conductive material or can be formed as multi-layer electrode as shown in FIG. 5. The first electrodes 220 includes a plating seed layer 221 formed on the electrode sheet 210 and a plating layer 222 plated on the plating seed layer 221. An insulating layer 240 can be formed on surfaces of the first electrodes 220 and the electrode sheet 210. Alternatively, the insulating layer 240 can be formed on the surface of the electrode sheet 210 so as to cover the first electrodes 220.

The plating seed layers 221 are base layers on the electrode sheet 210 on which the plating layers 222 are formed. The plating seed layers 221 can be formed of a flexible material that can be easily deposited on the electrode sheet 210, such as polyethersulfone resin or polyimide.

The second electrodes 230 include plating seed layers 231 and plating layers 232 like the first electrodes 220. In addition, an insulating layer 250 can be formed on surfaces of the second electrodes 230 and the electrode sheet 210, or the insulating layer 250 can be formed on the surface of the electrode sheet 210 to cover the second electrodes 230.

The plating layers 222 and 232 can be formed of a material that is conductive and can be plated easily on the plating seed layers 221 and 231, respectively.

Through the structures of the electrodes 220 and 230, including the plating seed layers 221 and 231 and the plating layers 222 and 232, the first and second electrodes 220 and 230 can be easily formed on the flexible electrode sheet 210.

The plating seed layers 221 and 231 and the plating layers 222 and 232 may be electroless seed layers and electroless plating layers. When the electroless seed layers and the electroless plating layers are used, the electrodes can be formed on the electrode sheet 210 more easily than when electro-seed layers and electroplating layers are used. The electrodes 220 and 230 may be formed on the surfaces of the electrode sheet 210 by chemical deposition or any other method.

The insulating layers 240 and 250 are formed on the plurality of electrodes 220 and 230. The insulating layers 240 and 250 can be formed on the entire electrode sheet 210 so as to cover the plurality of electrodes 220 and 230 or can be formed on some parts of the electrode sheet 210 so as to cover only the portions where the first and second electrodes 220 and 230 are formed.

The insulating layers 240 and 250 can be formed of various materials, for example, the same flexible material as that of the electrode sheet 210. For example, the insulating layers 240 and 250 can include polyethersulfone resin or polyimide. When the insulating layers 240 and 250 are formed of the flexible material, the electrode sheet 210 and the insulating layers 240 and 250 formed on the electrode sheet 210 are all flexible, and thus, the flexibility of the electrode sheet 210 can be improved. If the insulating layers 240 and 250 are formed of the same material as that of the electrode sheet 210, the degrees of flexibilities of the insulating layers 240 and 250 and the electrode sheet 210 can coincide with each other, and thus, cracks that can be formed in contacting portions between the insulating layers 240 and 250 and the electrode sheet 210 can be prevented. The insulating layers 240 and 250 have a same flexible characteristic as the electrode sheet 210.

Since the first and second electrodes 220 and 230 extend parallel in the Y direction, address electrodes 260 can be formed on the second substrate 290 to select in which the discharge spaces 210*a* a sustain discharge will occur. The address electrodes 260 can extend in a direction intersecting the direction where the first and second electrodes 220 and 230 extend. The address electrodes 260 can extend across the second substrate 290 in the X direction. The address electrodes 260 also include a plating seed layer 261 and a plating layer 262. In addition, an insulating layer 270 can be formed on the second substrate 290 and the address electrodes 260, or the insulating layer 270 can be formed only on the address electrodes 270.

In order to fill the gas in the discharge spaces 210*a*, the electrode sheet 210, the first substrate 280, and the second substrate 290 are first coupled to each other with the electrode sheet 210 disposed between the first and second substrates 280 and 290. The first and second substrates 280 and 290 can be compressed onto the electrode sheet 210 using a thermal compression method to seal the first and second substrates 280 and 290 at the sealing area 203.

The first and second substrates 280 and 290 are compressed to each other at the sealing area 203 that is formed in the non-display area 202 and coupled to each other. The sealing area 203 can include adhesive sheets 206 and 207 disposed between the first and second substrates 280 and 290 outside of the display area 201. The adhesive sheets 206 and 207 can include a thermo-setting epoxy resin.

Processes of compressing the first and second substrates 280 and 290 can include a process of attaching the adhesive sheets 206 and 207 to the first and second substrates 280 and 290 at the sealing area 203 and a process of contacting the first substrate 280, the second substrate 290, and the electrode sheet 210 to each other in order to apply a predetermined heat and a predetermined pressure to the first and second substrates 280 and 290.

When the adhesive sheets 206 and 207 are located at the sealing area 203 and the first and second substrates 280 and 290 are pressed while heated, the pressure and heat are transferred to the adhesive sheets 206 and 207, and thus, the first substrate 280, the second substrate 290, and the electrode sheet 210 are compressed and coupled to each other at the sealing area 203. A predetermined distance is maintained between the first and second substrates 280 and 290 in the display area 201; however, the flexible first and second substrates 280 and 290 can be bent and contact each other at the sealing area 203.

Instead of using the adhesive sheets 206 and 207, the first substrate 280, the second substrate 290, and the electrode sheet 210 can be coupled to each other using the thermal compression method. In the thermal compression method, heat and pressure are applied to the first substrate 280, the second substrate 290, and the electrode sheet 210 such that the first substrate 280, the second substrate 290, and the electrode sheet 210 contact and couple to each other at the sealing area 203.

In addition, the first substrate 280, the second substrate 290, and the electrode sheet 210 can be coupled using an ultrasonic wave fusing method to compress the first substrate 280, the second substrate 290, and the electrode sheet 210 at the sealing area 203 using ultrasonic waves.

When the thermal compression or the ultrasonic wave fusing method, which uses the characteristics of the flexible substrates, is used, the first substrate 280, the second substrate 290, and the electrode sheet 210 can be stably coupled at the sealing area 203. In addition, since the first substrate 280, the second substrate 290, and the electrode sheet 210 can be coupled using the simple compression process described above, the sealing process of the first and second substrates 280 and 290 can be easily effected. Furthermore, when using the thermal compression or the ultrasonic wave fusing, the sealing state between the first and second substrates 280 and 290 can be stably maintained.

FIG. 6 is a cross-sectional view showing a side portion of the plasma display panel of FIG. 4. The flexibility of the first and second substrates 280 and 290 is illustrated in FIG. 6 as the first and second substrates 280 and 290 allow for both an area in which the electrode sheet 210 and discharge spaces 210*a* are formed and an area in which the first and second substrates 280 and 290 are sealed. The first electrodes 220 are disposed on a surface of the electrode sheet 210 facing the first substrate 280. The first electrodes 220 include plating seed layers 221 and plating layers 222. The plating seed layers 221 are disposed on the surface of the electrode sheet 210 facing the first substrate 280, and the plating layers 222 are disposed on the plating seed layers 221. Insulating layer 240 is disposed on the surface of the electrode sheet 210 facing the first substrate 280 to cover the first electrodes 220. The second electrodes 230 are disposed on a surface of the electrode sheet 210 facing the second substrate 290. The second electrodes 230 include plating seed layers 231 and plating layers 232. The plating seed layers 231 are disposed on the surface of the electrode sheet 210 facing the second substrate 290, and the plating layers 232 are disposed on the plating seed layers 231. Insulating layer 250 is disposed on the surface of the electrode sheet 210 facing the second substrate 290 to cover the second electrodes 230. Insulating layers 240 and 250 can be formed on the surfaces of the electrode sheet 210 or can be formed on the surfaces of the first and second electrodes 220 and 230.

The discharge spaces 210*a* are disposed in the electrode sheet 210. The discharge spaces 210*a* are each coated with phosphor layers (not shown). The discharge spaces 210*a* are formed between the first and second substrates 280 and 290; and more particularly, the discharge spaces 210*a* are formed in the electrode sheet 210 between the first substrate 280 and an insulating layer 270 disposed on the surface of the second substrate 290. The discharge spaces 210*a* hold discharge gas that is excited by a voltage potential applied thereto via the address electrodes 260 and the first and second electrodes 220 and 230. The first and second electrodes 220 and 230 are also disposed to correspond to the discharge spaces 210*a*. The address electrodes 260 and the first and second electrodes 220 and 230 are disposed to cross and identify a particular discharge space 210*a*.

The address electrodes 260 are disposed on the surface of the second substrate 290 and extend to cross the first and second electrodes 220 and 230. The insulating layer 270 is disposed on the surface of the second substrate 290 to cover the address electrodes 260. The address electrodes 260 include plating seed layers 261 and plating layers 262. The plating seed layers 261 are disposed on the surface of the second substrate 290, and the plating layers 262 are disposed on the plating seed layers 261. The address electrodes 260, however, are not limited thereto. The address electrodes 260 may be disposed in the electrode sheet 210 or be shaped to surround at least a portion of the discharge spaces 210*a*.

As illustrated in FIG. 3, adhesive sheets 206 and 207 are disposed between the first substrate 280 and the second substrate 290; and more particularly, the adhesive sheet 206 is disposed between the first substrate 280 and the electrode sheet 210, and the adhesive sheet 207 is disposed between the electrodes sheet 210 and the insulating layer 270 disposed on the surface of the second substrate 290. Also, the adhesive sheets 206 and 207 need not be formed between the first and the second substrate 280 and 290 and the electrode sheet 210 as the first and the second substrates 180 and 190 and the electrode sheet 210 may be directly coupled, as described above.

According to aspects of the present invention, the substrates of the plasma display panel are sealed by being compressed at the sealing area, and thus, the sealing process of the plasma display panel including the flexible substrates can be easily and stably effected.

In addition, since the flexible substrates are compressed at the sealing area, the coupling of the substrates can be made stable, and the sealing state of the plasma display panel can be stably maintained.

While there have been illustrated and described what are considered to be example aspects of the present invention, it will be understood by those skilled in the art, and as technology develops, that various changes and modifications, may be made, and equivalents may be substituted for elements thereof without departing from the true scope of the present invention. Many modifications, permutations, additions, and sub-combinations may be made to adapt the teachings of the present invention to a particular situation without departing from the scope thereof. For example, the area in which the substrates are sealed may vary or allow for coupling of multiple display panels to share at least a sealing area. Furthermore, locations of electrodes and materials may be easily substituted while remaining within the scope of the present invention. Finally, all elements of the disclosed plasma display panel according to aspects of the current invention, including the substrates, electrodes, and seal, can be formed to have a same flexible characteristic so as to prevent cracking associated with bending the plasma display panel.

What is claimed is:

1. A plasma display panel, comprising:

a first flexible substrate;

a second flexible substrate disposed to face the first flexible substrate;

flexible barrier ribs disposed between the first and second flexible substrates to separate the first flexible substrate and the second flexible substrate with a gap, and to define discharge spaces between the first and second flexible substrates;

flexible electrodes disposed between the first and second flexible substrates; and a sealing area at a periphery of the first and second flexible substrates for sealing the first flexible substrate and the flexible second substrate.

2. The plasma display panel of claim 1, wherein the first flexible substrate and the second flexible substrate are sealed using a thermal compression method to compress the first and second flexible substrates at the sealing area.

3. The plasma display panel of claim 1, wherein the sealing area comprises: a flexible adhesive sheet disposed between the first flexible substrate and the second flexible substrate, wherein the first flexible substrate and the second flexible substrate are coupled to each other when the adhesive sheet is compressed with heat between the first flexible substrate and the second flexible substrate.

4. The plasma display panel of claim 1, wherein the first flexible substrate and the second flexible substrate are compressed using ultrasonic waves at the sealing area.

5. A plasma display panel, comprising:

an electrode sheet having a plurality of electrodes and a plurality of discharge spaces;

a first substrate; and a second substrate arranged to face the first substrate, wherein the electrode sheet is disposed between the first substrate and the second substrate to separate the first substrate and the second substrate with a gap, and to define discharge spaces between the first and second substrates, and the first substrate, the second substrate, and the electrode sheet are flexible, and the first substrate, the second substrate, and the electrode sheet are flexibly sealed at a periphery of the first and second substrate.

6. The plasma display panel of claim 5, further comprising:

a display area to display images using a gas discharge, wherein the discharge spaces and the electrodes are disposed in the display area; and a non-display area surrounding the display area, wherein the non-display area includes a sealing area at the periphery of the first and second substrates in which the first substrate, the second substrate, and the electrode sheet are compressed and coupled to each other.

7. The plasma display panel of claim 6, wherein the first substrate, the second substrate, and the electrode sheet are sealed by a thermal compression at the sealing area.

8. The plasma display panel of claim 6, further comprising:

adhesive sheets disposed between the first substrate and the electrode sheet and between the electrode sheet and the second substrate, wherein the first substrate, the second substrate, and the electrode sheet are coupled when the adhesive sheet is compressed between the first substrate and the second substrate and heated.

9. The plasma display panel of claim 6, wherein the first substrate, the second substrate, and the electrode sheet are sealed using ultrasonic waves at the sealing area.

* * * * *